US008955453B2

(12) United States Patent
Angelow

(10) Patent No.: US 8,955,453 B2
(45) Date of Patent: Feb. 17, 2015

(54) PERSONAL LAND-SEA TRANSPORT APPARATUS

(71) Applicant: Justin Angelow, Faribault, MN (US)

(72) Inventor: Justin Angelow, Faribault, MN (US)

( * ) Notice: Subject to any disclaimer, the term of this patent is extended or adjusted under 35 U.S.C. 154(b) by 175 days.

(21) Appl. No.: 13/666,006

(22) Filed: Nov. 1, 2012

(65) Prior Publication Data

US 2013/0104791 A1 May 2, 2013

Related U.S. Application Data

(60) Provisional application No. 61/554,087, filed on Nov. 1, 2011.

(51) Int. Cl.
*B63C 13/00* (2006.01)

(52) U.S. Cl.
CPC ..... *B63C 13/00* (2013.01)
USPC ..... 114/344

(58) Field of Classification Search
USPC ..... 114/344, 347
IPC ..... B63C 13/00
See application file for complete search history.

(56) References Cited

U.S. PATENT DOCUMENTS

| | | | | |
|---|---|---|---|---|
| 3,858,260 | A | 1/1975 | Hanser | |
| 3,986,723 | A | 10/1976 | Brockelsby | |
| 4,392,665 | A | 7/1983 | Miller et al. | |
| 4,602,802 | A | 7/1986 | Morgan | |
| 4,824,127 | A * | 4/1989 | Stamm | 280/47.331 |
| 4,830,387 | A * | 5/1989 | Batten | 280/47.331 |
| 5,320,371 | A * | 6/1994 | Levad | 280/204 |
| 6,032,964 | A | 3/2000 | Capobianco | |
| 6,142,492 | A | 11/2000 | DeLucia | |
| 2002/0014195 | A1 | 2/2002 | Burlet | |
| 2005/0247819 | A1 | 11/2005 | Caruso | |
| 2006/0186635 | A1 * | 8/2006 | Stewart | 280/414.3 |
| 2010/0206212 | A1 | 8/2010 | Lazarevic | |
| 2011/0048311 | A1 * | 3/2011 | Hosey | 114/344 |

* cited by examiner

*Primary Examiner* — Stephen Avila
(74) *Attorney, Agent, or Firm* — Buckingham Doolittle & Burroughs, LLC

(57) ABSTRACT

A transportation apparatus for use as a towable watercraft is provided. The transportation device comprises a watercraft component, a mounting component, and an axle component. The transportation apparatus allows a single user to tow and portage the transportation apparatus with a standard bicycle.

17 Claims, 4 Drawing Sheets

PERSONAL LAND-SEA TRANSPORT APPARATUS

CROSS-REFERENCE

This application claims priority from Provisional Patent Application Ser. No. 61/554,087 filed Nov. 1, 2011.

FIELD OF THE INVENTION

This invention pertains generally to a transportation apparatus for use on water or land, and more particularly to a transportation apparatus for use as a towable kayak on land that can transport a towing apparatus when used in water.

BACKGROUND

Kayaks and other similar watercraft require transport to and from a waterway, typically by vehicle, for use. Traditional Kayak portage requires a vehicle at both the entry point and the exit point from the water. As such, it is very inconvenient for a single individual to use the kayak unless they return the kayak by water to the point of entry. While this is possible in lakes, the currents in rivers make this return trip impractical. Unless the user has a second individual willing to recover the kayak from a downstream exit point, the user would have to portage or carry the kayak over land. This typically involves flipping the cumbersome kayak upside down so that it may be carried overhead. This is not only physically taxing, but creates a risk of injury. Furthermore, as the kayak must be carried upside down, there is no way to carry any equipment that was in the boat, necessitating a second trip to retrieve any equipment left behind.

Consequently, there is a need for a modified kayak operable on both water and land that is transportable by a single person. The proposed invention allows a user to tow the kayak to and from the water via bicycle, and then allows the bicycle to be mounted on the kayak for transportation on water. This eliminates the need for having a vehicle at both the entry point and the exit point of the kayak route. Additionally, the bicycle may be used as the only transport vehicle, saving fuel and money. Further, the user may avoid the cumbersome, heavy lifting required in traditional portaging as the kayak never needs to be rotated or flipped to remove it from the water. The user simply needs to re-hitch the kayak to the bicycle and pedal it out of the water.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a transportation apparatus for use as a towable watercraft. The transportation device comprises a watercraft component, a mounting component, and an axle component. The transportation apparatus allows a user to tow and portage the watercraft component with a standard bicycle.

Furthermore, in a preferred embodiment, the watercraft component comprises a kayak modified with a mounting component. The mounting component comprises a bicycle attachment portion used to attach a bicycle to the kayak while in the water. The mounting component further comprises a trailer attachment portion that allows the kayak to be towed by the bicycle on land. The axle component comprises an axle tube for attaching a first and a second axle comprising a first and a second wheel. The first and the second wheels are rotatable between an up position and a down position. When on land, the first and the second wheels are locked in the down position for contact with the ground allowing the kayak to be towed by the bicycle. When in the water, the first and the second wheels are rotated to and locked in the up position so that they do not contact the ground allowing the kayak to be used as a watercraft while carrying the bicycle.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
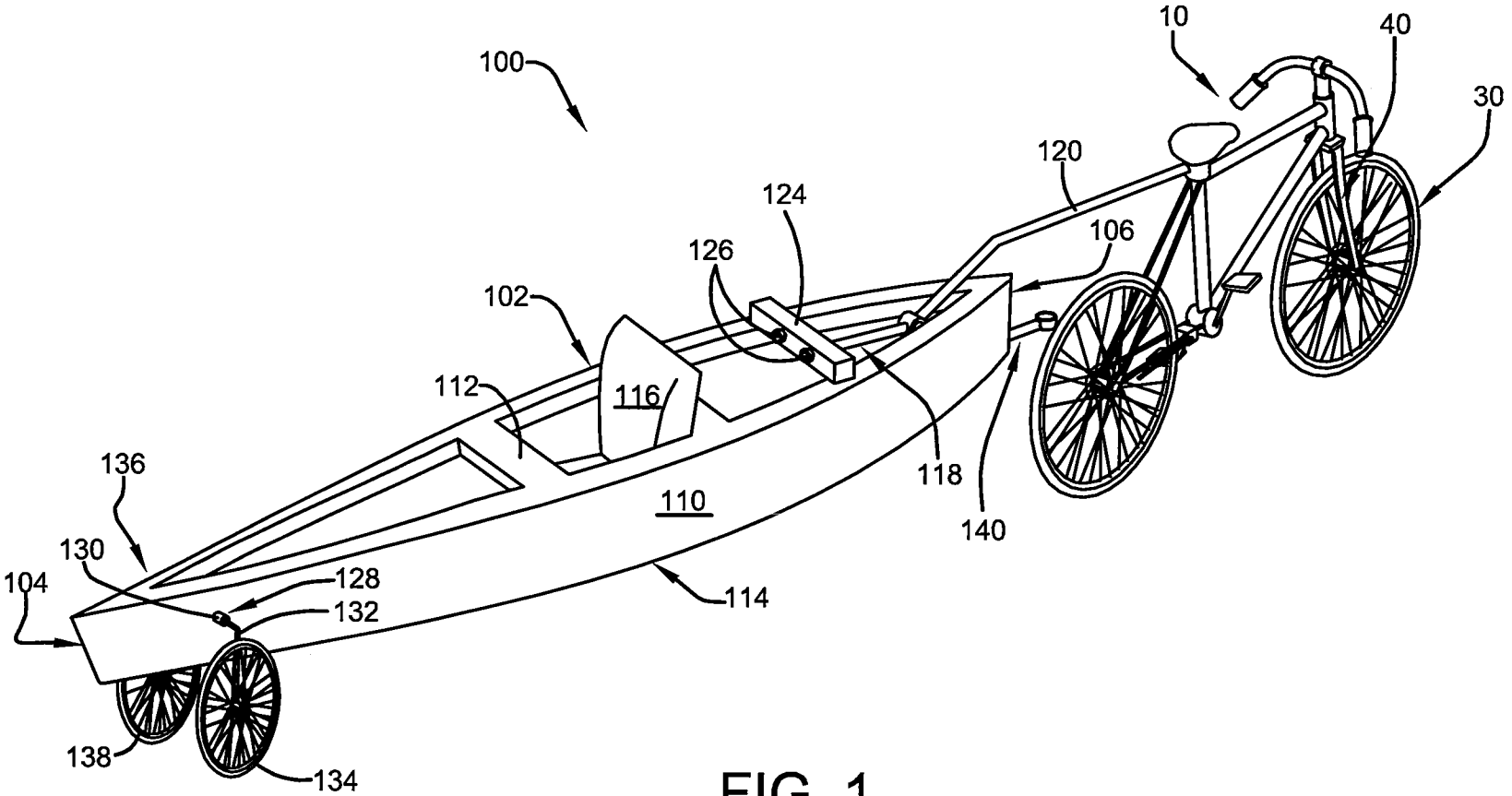
FIG. 1 illustrates a perspective view of a transportation apparatus.

The present invention discloses a transportation device such as a kayak, a canoe, a boat, and the like, that allows a user to tow and portage the transportation device with a standard bicycle. The preferred embodiment allows a single user to transport the kayak by land to an entry point of a waterway and to transport the bicycle on the kayak to an exit point of the waterway. Once at the exit point, the user may transport the kayak over land via the bicycle without the need for an additional method of transport.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

Figure 2:
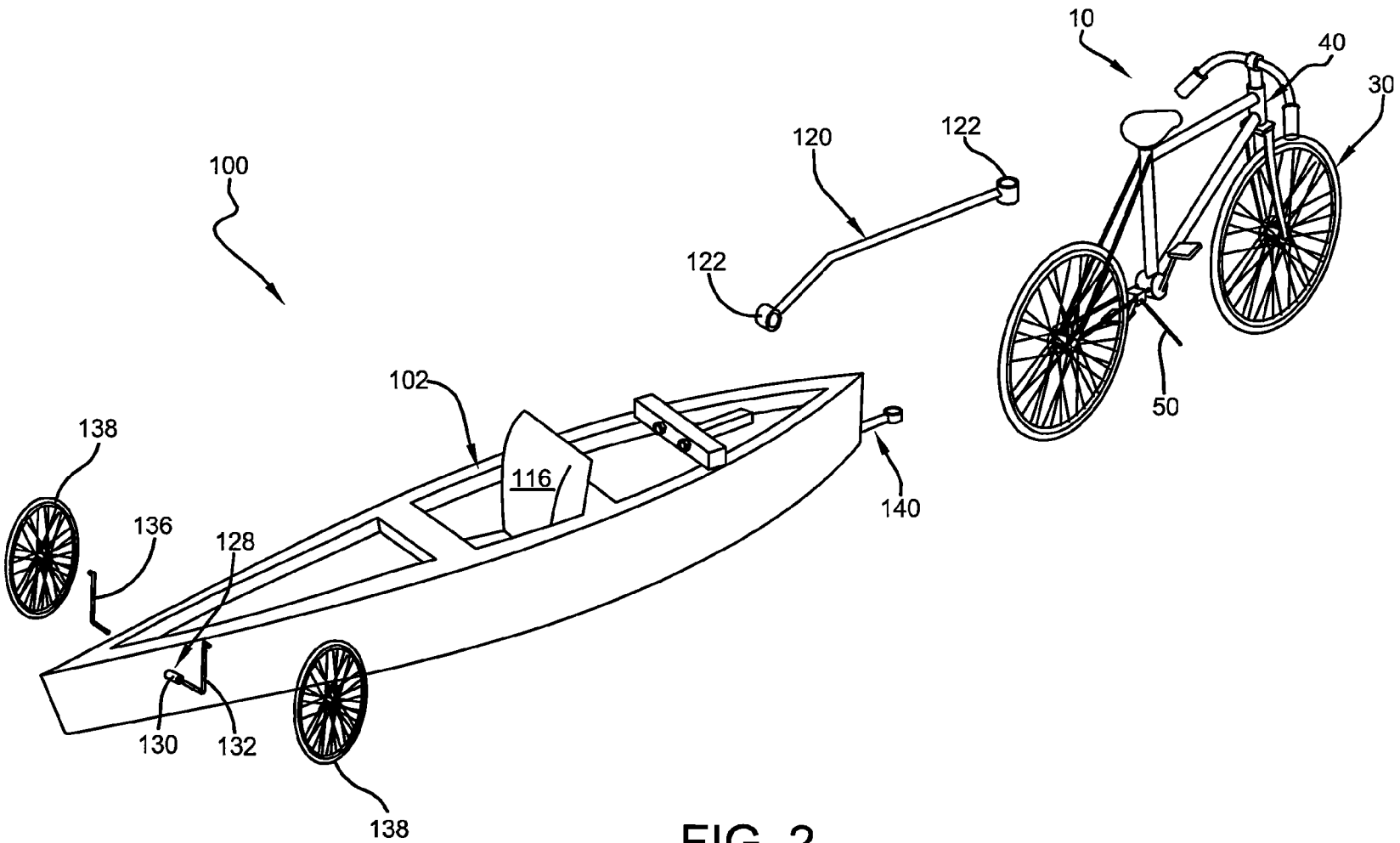
FIG. 2 illustrates an exploded view of the transportation apparatus.

Referring initially to the drawings, FIGS. 1 and 2 illustrate a transportation apparatus 100 for use as a towable watercraft on land and water. The transportation apparatus 100 comprises a watercraft component 102, a mounting component 118, and an axle component 126. While the watercraft component 102 is preferably a kayak, any other one or two person watercraft towable by a bicycle, such as but not limited to a canoe, a sailboat, and a rowboat may be used without affecting the overall scope of the invention.

The mounting component 118 is affixed to a rear portion 106 of the watercraft component 102 behind a seat 116 in the watercraft component 102. The mounting component 118 is typically a slotted molded plastic support member integrated into a top portion 112 of the watercraft component 102. While the mounting component 118 may be molded into the top portion 112, any other method of attaching the mounting component 118 may be used, such as but not limited to radio frequency welding, adhesives, mechanical fasteners, and the like. Similarly, the mounting component 118 material may comprise polymers, carbon, metal, fiberglass, and the like, or any other material known to those of skill in the art. For example, the mounting component 118 could be bolted to the top portion 112 of an existing kayak.

Figure 3:
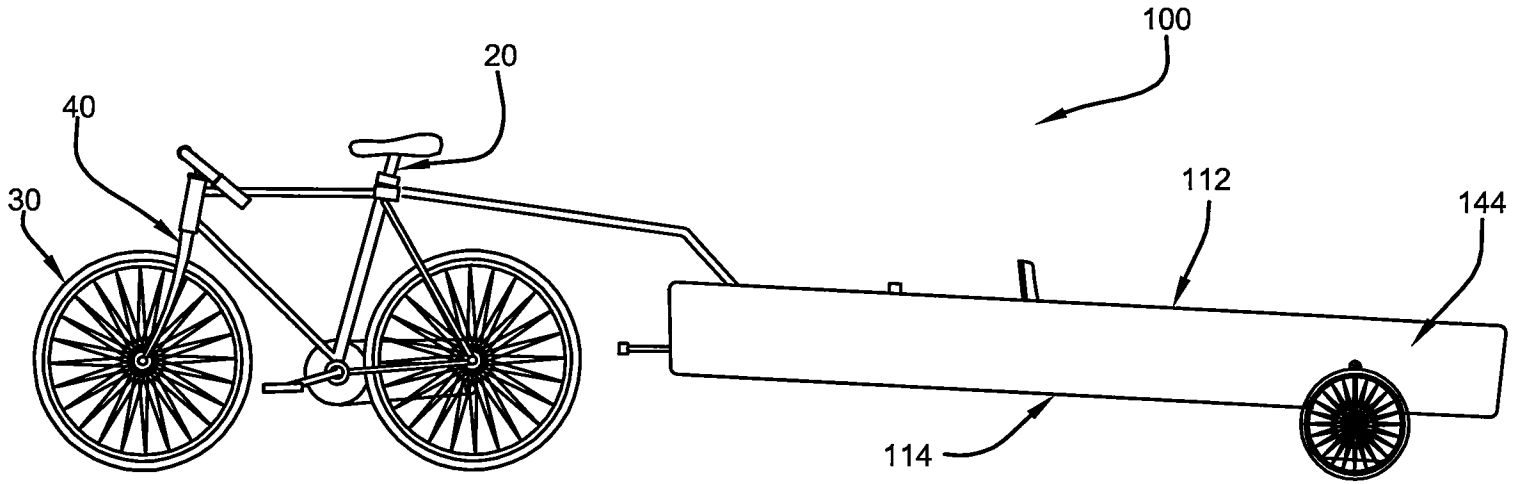
FIG. 3 illustrates a perspective view of the transportation apparatus as used on land.

The mounting component 118 comprises a trailer attachment portion 120 and a bicycle attachment portion 124. The trailer attachment portion 120 is typically a metal or plastic hitch bar attachable to the bicycle with a quick release connection 122. To accommodate most standard bicycles, the trailer attachment portion 120 may comprise a rod, bar, section of tubing, and the like, approximately five feet in length with a bend or curve along the length so that it is approximately 12 inches higher at a bicycle attachment end from a mounting component end. However, the dimensions may range from approximately between four to six feet in length and approximately between eight and twenty inches in height to fit nonstandard bicycles as well. As illustrated in FIG. 3, the bicycle attachment end is attachable to a seat post 20 of the bicycle 10 for transport on land. Additionally, the trailer attachment portion 120 may utilize the quick release connection 122 on either or both ends as desired. The trailer attachment portion 120 is removable as needed.

Figure 4:
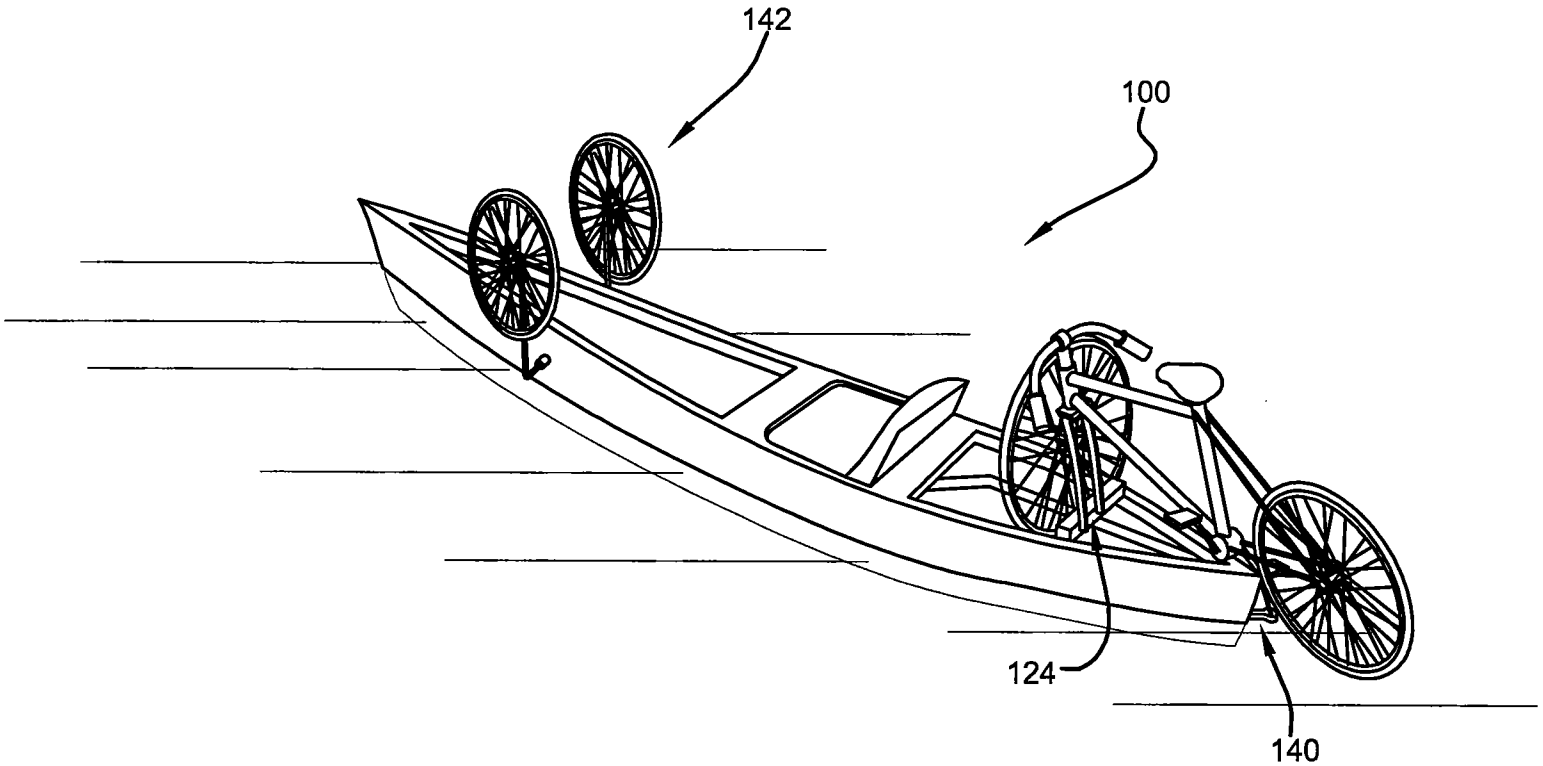
FIG. 4 illustrates a perspective view of the transportation apparatus as used on water.

The bicycle attachment portion 124 comprises a plurality of attachment points 126 integrated with the mounting component 118. The bicycle attachment portion 124 may further comprise a prior art center mount type bicycle rack with a rail track approximately between 12 and 24 inches in length that can lock the bicycle 10 in place with a quick release mechanism or nuts and bolts. To attach the bicycle 10 to the transportation apparatus 100 for use in water, a user removes a front tire 30 of the bicycle 10 and mounts the front tire 30 flat against the bicycle attachment portion 124 in a perpendicular orientation as illustrated in FIG. 4. A front fork 40 of the bicycle 10 is mounted to the bicycle attachment portion 124 so that the bicycle is generally in line with or parallel to the watercraft component 102 extending out from the rear portion 106 of the watercraft component 102. In other words, once mounted the front fork 40 of the bicycle 10 will be substantially perpendicular to the removed front tire 30.

The transportation apparatus 100 further comprises a bicycle kickstand attachment component 140. The bicycle kickstand attachment component 140 may be removably attached or permanently integrated with an exterior portion 110 at the rear of the watercraft component 102. The kickstand 50 of the bicycle 10 is typically attached with a standard bolt. The standard bolt may be replaced with a longer bolt approximately between six and eight inches in length. The longer bolt may be secured to the bicycle kickstand attachment component 140 by friction, nuts, a quick release lever, or the like. Alternatively, if the bicycle 10 does not have a kickstand, the bicycle kickstand attachment component 140 may comprise a pair of plates (not shown) that sandwich a frame of the bicycle 10 where the kickstand 50 would normally mount to the bicycle 10. After the front fork 40 of the bicycle 10 is attached to the bicycle attachment portion 124, a kickstand 50 of the bicycle 10 may be locked into position on the bicycle kickstand attachment component 140 to provide additional stability.

The transportation apparatus 100 further comprises an axle component 128. The axle component 128 comprises an axle tube 130 molded into or otherwise integrated with the front portion 104 of the watercraft component 102. The axle tube 130 transects the watercraft component 102 perpendicularly extending from side to side. The axle component 128 further comprises a first axle 132 and a second axle 136. The first axle 132 and the second axle 136 are mountable to and extend approximately between ten and fourteen inches out of the axle tube 130 on opposite sides of the watercraft component 102. Furthermore, the first axle 132 and the second axle 136 are rotatable within the axle tube 130.

The first axle 132 comprises a first wheel 134, and the second axle 136 comprises a second wheel 138. Both the first and the second wheels 134 and 138 are typically standard pneumatic wheels between fourteen and eighteen inches in diameter. Additionally, the first and the second wheels 134 and 138 are adjustable in that they may rotate between an up position 142 and a down position 144.

When used on land, the first and the second wheels 134 and 138 are lockable in place in the down position 144 so that the first and the second wheels 134 and 138 extend approximately between eight and ten inched below a bottom 114 of the watercraft component 102. In other words, in the down position 144 the bottom 114 of the watercraft component 102 is elevated via the wheels 134 and 138 approximately between eight and ten inches off of the ground at a low point while the transportation apparatus 100 is towed. The first and the second axles 132 and 136 are rotatable approximately 180 degrees from the down position 144 to the up position 142 when the transportation apparatus 100 is used on water. Thus, the first and the second wheels 134 and 138 are rotated 180 degrees off of the ground and extend above the top 112 of the watercraft component 102 when in the up position 142. The first and the second axles 132 and 136 are then lockable in the up position 142. Once the transportation apparatus 100 is no longer used on the water, the first and the second axles 132 and 136 are unlocked and the first and the second wheels 134 and 138 may be returned to the down position 144 for towing.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A transportation apparatus comprising:

a watercraft component;

a mounting component affixed to the watercraft component; the mounting component comprising a trailer attachment portion and a bicycle attachment portion; and an axle component mounted to the watercraft component, the axle component comprising an axle tube integrated into a front portion of the watercraft component for attaching a first axle and a second axle to the watercraft component, wherein the first axle comprises a first wheel and the second axle comprises a second wheel; and wherein the first and the second axles are offset between approximately ten and fourteen inches extending away from the watercraft component and rotate approximately 180 degrees between an up position and a down position.

2. The transportation apparatus of claim 1, wherein the watercraft component comprises a Kayak, a canoe, a sailboat, or a rowboat.

3. The transportation apparatus of claim 2, wherein the trailer attachment portion is attachable to a bicycle.

4. The transportation apparatus of claim 2, wherein the bicycle attachment portion is between approximately 12 and 24 inches in length.

5. The transportation apparatus of claim 4, wherein the bicycle attachment portion comprises a plurality of attachment elements.

6. The transportation apparatus of claim 5, further comprising a bicycle kickstand attachment component attachable to an exterior of the watercraft component.

7. A transportation apparatus for use as a towable watercraft, the device comprising:

a watercraft component;

a mounting component removably affixed to the watercraft component, the mounting component comprising a trailer attachment portion for attaching the watercraft component to a bicycle on land, and a bicycle attachment portion for attaching the bicycle to the watercraft component when in water; and an axle component comprising an axle tube integrated into a front portion of the watercraft component for attaching a first axle and a second axle to the watercraft component, wherein the first axle comprises a first wheel and the second axle comprises a second wheel; and wherein the first and the second axles are offset between approximately ten and fourteen inches extending away from the watercraft component and rotate approximately 180 degrees between an up position and a down position.

8. The transportation apparatus of claim 7, wherein the trailer attachment portion is between approximately four and six feet in length and is approximately between eight and twenty inches in height.

9. The transportation apparatus of claim 8, wherein the trailer attachment portion further comprises a quick release connection.

10. The transportation apparatus of claim 7, wherein a bottom of the watercraft component is elevated above ground between approximately eight and ten inches when the first and the second axles are in the down position.

11. The transportation apparatus of claim 7, wherein the first wheel and the second wheel are lockable in place in the up position and the down position.

12. A transportation apparatus for use as a towable kayak, the device comprising:

a kayak;

a mounting component integrated into a rear portion of the kayak, the mounting component comprising a trailer attachment portion for attaching the kayak to a bicycle on land, and a bicycle attachment portion for attaching the bicycle to the kayak when in water; and an axle component comprising an axle tube integrated into a front portion of the watercraft component for attaching a first axle and a second axle to the kayak, wherein the first axle comprises a first adjustable wheel and the second axle comprises a second adjustable wheel; and a bicycle kickstand attachment component attachable to an exterior portion of the kayak; and wherein a removed front tire of the bicycle mounts to the bicycle attachment portion of the mounting component.

13. The transportation apparatus of claim 12, wherein a front fork of the bicycle mounts to the bicycle attachment portion substantially perpendicularly to the removed front tire.

14. The transportation apparatus of claim 13, wherein a kickstand of the bicycle mounts to the bicycle kickstand attachment component when the front fork of the bicycle is mounted to the bicycle attachment portion.

15. The transportation apparatus of claim 12, wherein the trailer attachment portion, the bicycle attachment portion, and the bicycle kickstand attachment component are detachable.

16. The transportation apparatus of claim 12, wherein the first and the second axles rotate approximately 180 degrees between an up position for use in water and a down position for use on land.

17. The transportation apparatus of claim 16, wherein the first and the second axles are lockable in the up position and the down position.

* * * * *